US011710924B2

(12) United States Patent
Zhao et al.

(10) Patent No.: US 11,710,924 B2
(45) Date of Patent: Jul. 25, 2023

(54) CONNECTOR HOUSING WITH LOCKING COVER

(71) Applicant: Tyco Electronics (Shanghai) Co. Ltd., Shanghai (CN)

(72) Inventors: YuQiang (Thomas) Zhao, Shanghai (CN); Qianjin (Orando) Li, Shanghai (CN)

(73) Assignee: Tyco Electronics (Shanghai) Co., Ltd., Shanghai (CN)

( * ) Notice: Subject to any disclaimer, the term of this patent is extended or adjusted under 35 U.S.C. 154(b) by 0 days.

(21) Appl. No.: 17/393,484

(22) Filed: Aug. 4, 2021

(65) Prior Publication Data

US 2022/0045454 A1 Feb. 10, 2022

(30) Foreign Application Priority Data

Aug. 4, 2020 (CN) ..... 202021591659.6

(51) Int. Cl.

| | |
|---|---|
| ***H01R 13/506*** | (2006.01) |
| ***H01R 13/42*** | (2006.01) |
| ***H01R 13/516*** | (2006.01) |
| ***H01R 13/627*** | (2006.01) |

(52) U.S. Cl.

CPC ..... *H01R 13/506* (2013.01); *H01R 13/42* (2013.01); *H01R 13/516* (2013.01); *H01R 13/6275* (2013.01)

(58) Field of Classification Search

CPC .. H01R 13/447; H01R 13/502; H01R 13/503; H01R 13/506; H01R 13/516; H01R 13/518; H01R 13/627; H01R 13/5213

See application file for complete search history.

(56) References Cited

U.S. PATENT DOCUMENTS

| | | | | |
|---|---|---|---|---|
| 4,435,035 A * | 3/1984 | Berry | ..... | H01R 4/2466 439/404 |
| 4,767,345 A * | 8/1988 | Gutter | ..... | H01R 13/514 439/594 |
| 6,165,012 A * | 12/2000 | Abe | ..... | H01R 4/2433 439/465 |
| 6,296,530 B1 * | 10/2001 | Yoneda | ..... | H01R 13/4368 439/701 |

* cited by examiner

*Primary Examiner* — Oscar C Jimenez
(74) *Attorney, Agent, or Firm* — Barley Snyder

(57) ABSTRACT

A connector housing includes a body and a cover mounted on a top portion of the body. The body has a plurality of terminal receiving chambers arranged in a row and a first engagement portion formed on a top surface of each wall at a left side and a right side of each terminal receiving chamber. The cover has a first aperture corresponding to the first engagement portion. The first engagement portion engages the first aperture to lock the cover to the body.

20 Claims, 4 Drawing Sheets

CONNECTOR HOUSING WITH LOCKING COVER

CROSS-REFERENCE TO RELATED APPLICATION

This application claims the benefit of the filing date under 35 U.S.C. § 119(a)-(d) of Chinese Patent Application No. 202021591659.6, filed on Aug. 4, 2020.

FIELD OF THE INVENTION

The present invention relates to a housing and, more particularly, to a connector housing.

BACKGROUND

A connector housing commonly includes a body and a cover. The body is formed with a plurality of terminal receiving chambers therein. The cover is mounted on a top portion of the body. When mounted on the body, the cover may hold wires inserted into the terminal receiving chambers within the terminal receiving chambers, so that the wires are in reliable electrical contact with terminals in the terminal receiving chambers.

Two protrusions can be formed on each of left and right sides of the cover, and apertures corresponding to the protrusions are formed on side walls of the body. The protrusions are engaged into the apertures, respectively, thereby locking the cover onto the body. However, the existing assembly structure cannot improve a holding force applied on the wires by the cover, resulting in unreliable contact between the wires and the terminals, and even disconnection therebetween.

SUMMARY

A connector housing includes a body and a cover mounted on a top portion of the body. The body has a plurality of terminal receiving chambers arranged in a row and a first engagement portion formed on a top surface of each wall at a left side and a right side of each terminal receiving chamber. The cover has a first aperture corresponding to the first engagement portion. The first engagement portion engages the first aperture to lock the cover to the body.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
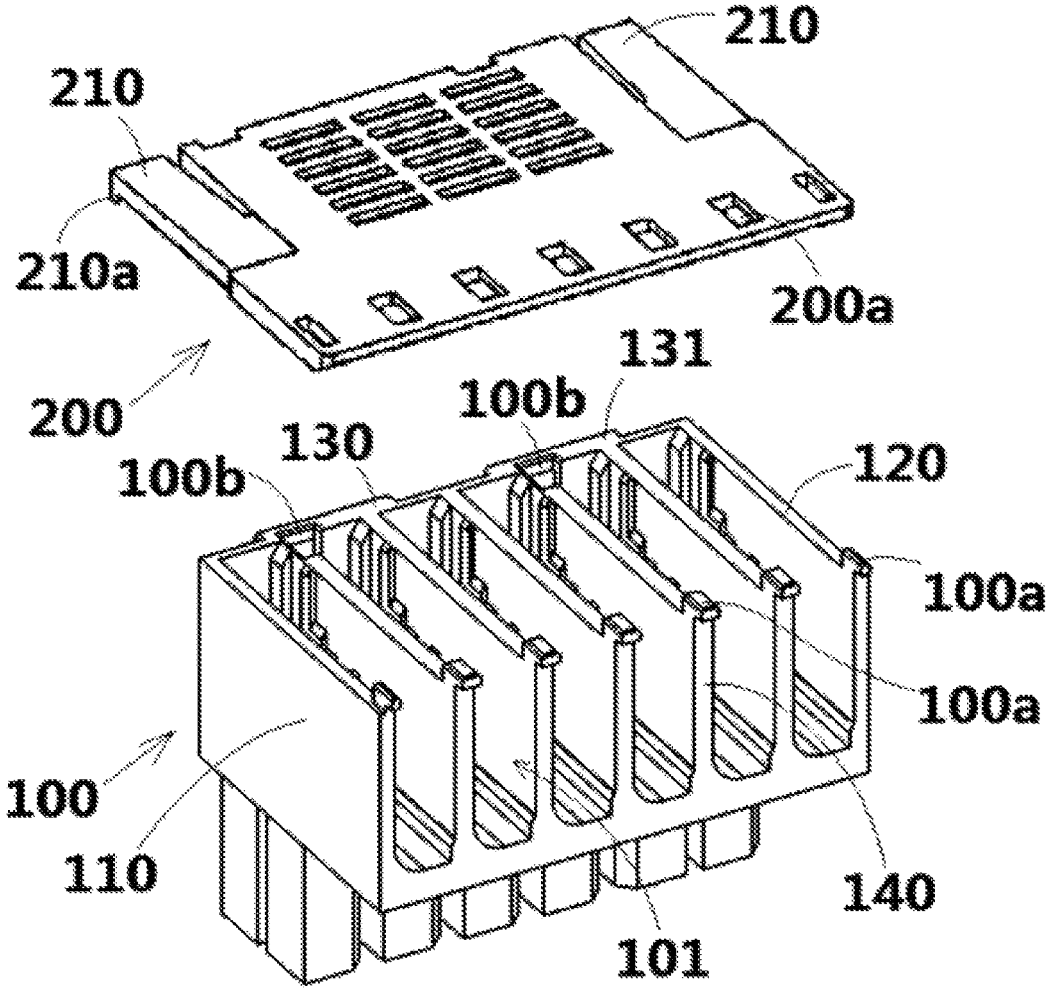
FIG. 1 is an exploded perspective view of a connector housing according to an embodiment.
Figure 2A:
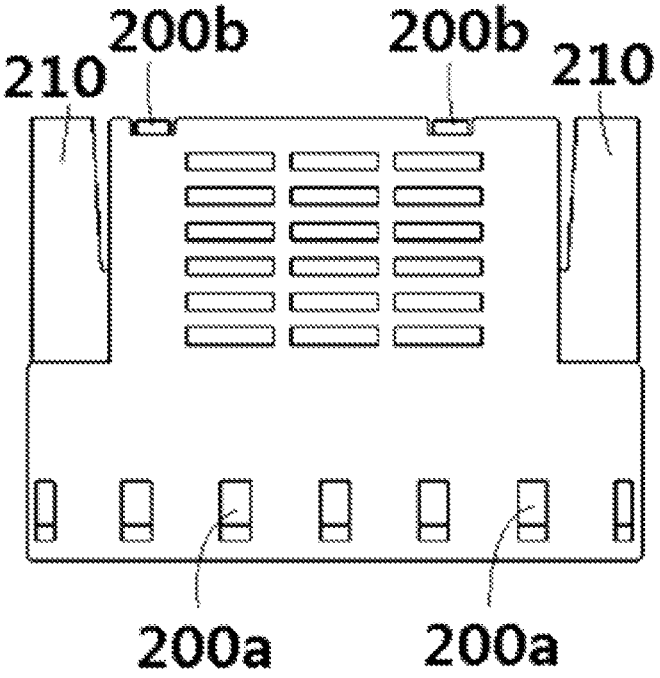
FIG. 2A is a top view of a cover of the connector housing.
Figure 2B:
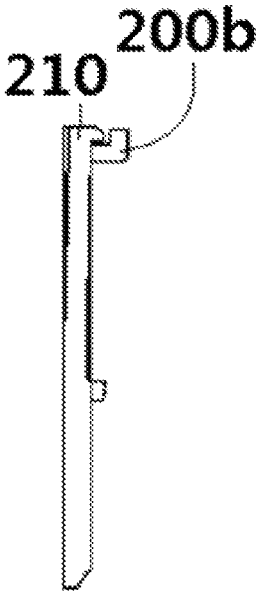
FIG. 2B is a side view of the cover of the connector housing.

Embodiments of the present disclosure will be described hereinafter in detail taken in conjunction with the accompanying drawings. In the description, the same or similar parts are indicated by the same or similar reference numerals. The description of each of the embodiments of the present disclosure hereinafter with reference to the accompanying drawings is intended to explain the general inventive concept of the present disclosure and should not be construed as a limitation on the present disclosure.

In addition, in the following detailed description, for the sake of explanation, numerous specific details are set forth in order to provide a thorough understanding of the disclosed embodiments. It will be apparent, however, that one or more embodiments may also be practiced without these specific details. In other instances, well-known structures and devices are illustrated schematically in order to simplify the drawing.

A connector housing according to an embodiment, as shown in FIGS. 1 to 4, comprises a body 100 and a cover 200. In an embodiment, the body 100 and the cover 200 are made of an insulative material, such as plastic.

The body 100, as shown in FIGS. 1 to 4, has a plurality of terminal receiving chambers 101 arranged in a row. A terminal is mounted in each terminal receiving chamber 101, and the terminal can be in electrical contact with an external wire inserted into the terminal receiving chamber 101.

As shown in FIGS. 1 to 4, in the illustrated embodiment, the cover 200 is mounted on a top portion of the body 100. The cover 200 can apply a holding force onto the inserted external wire, so that the inserted external wire is held in the terminal receiving chamber 101 and is brought in reliable electrical contact with the terminal. The engagement portions described below allow a holding force for holding a wire within the terminal receiving chamber 101 by the cover 200 to be greatly improved.

Figure 3:
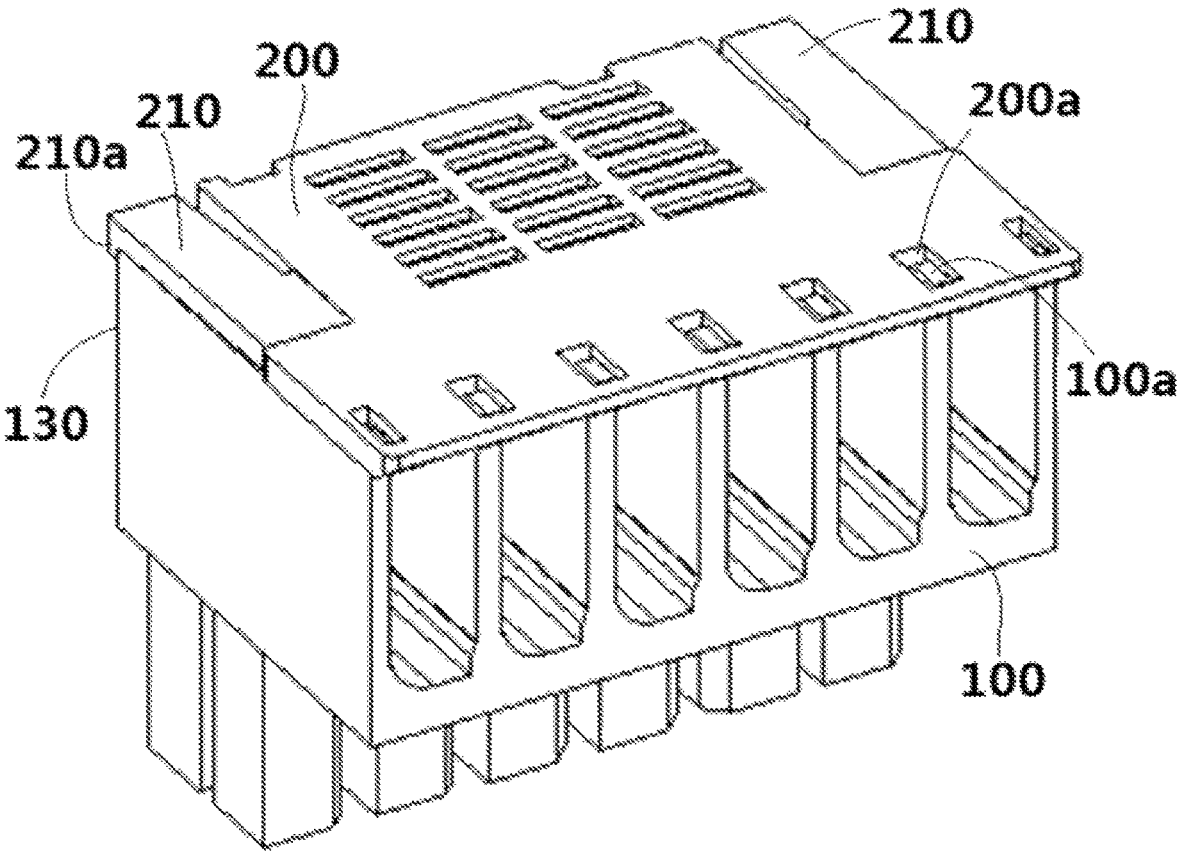
FIG. 3 is a rear perspective view of the connector housing.
Figure 4:
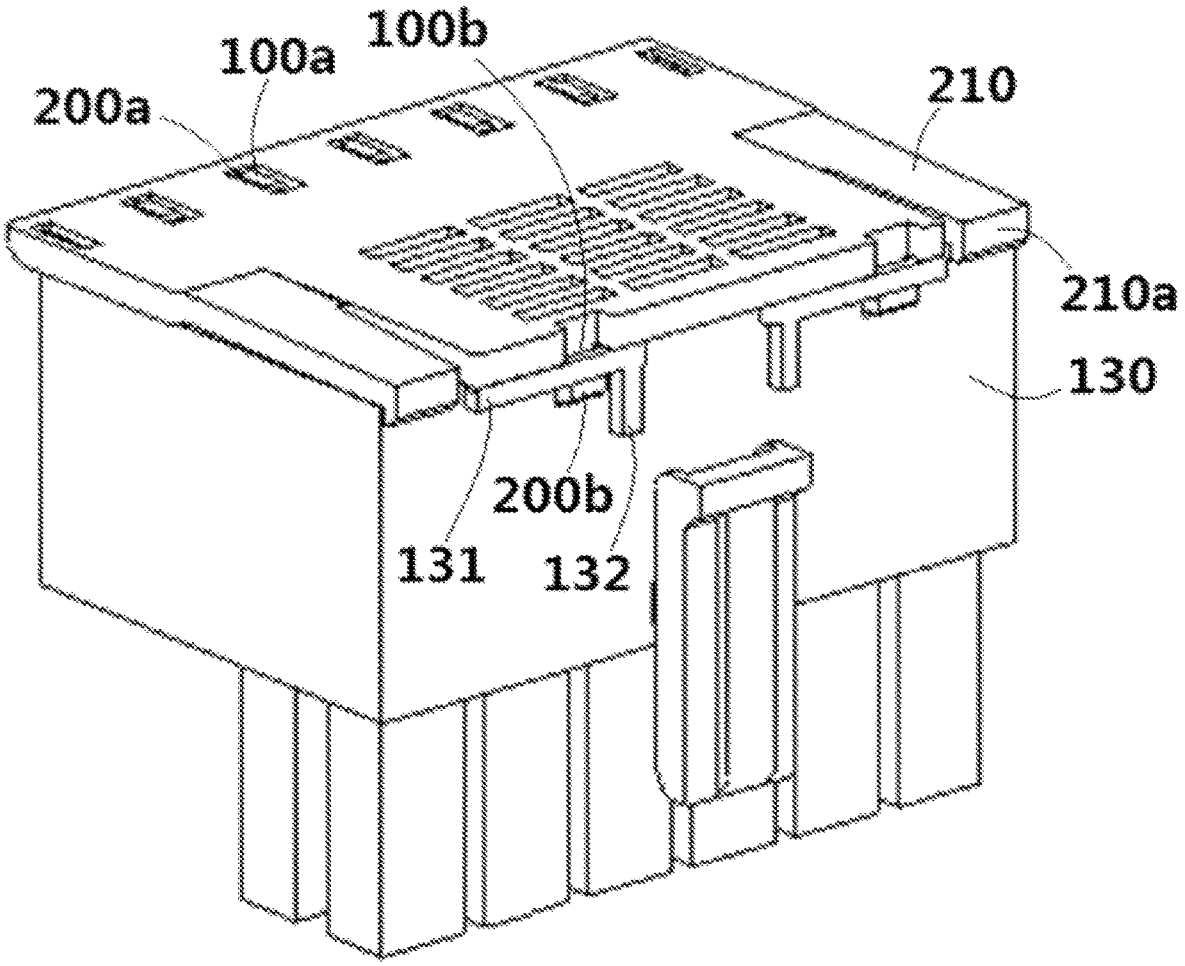
FIG. 4 is a front perspective view of the connector housing.

As shown in FIGS. 1, 3, and 4, a first engagement portion 100*a* is formed on a top surface of each wall at left and right sides of each terminal receiving chamber 101, and a first aperture 200*a* corresponding to the first engagement portion 100*a* is formed in the cover 200. The first engagement portion 100*a* is configured to be engaged into the first aperture 200*a* to lock the cover 200 onto the body 100.

The body 100, as shown in FIGS. 1, 3, and 4, has a left side wall 110, a right side wall 120, a front side wall 130 and a plurality of partition walls 140. The plurality of partition walls 140 divide an internal space of the body 100 into the plurality of terminal receiving chambers 101. The first engagement portion 100*a* is formed on a top surface of each of the left side wall 110, the right side wall 120, and the plurality of partition walls 140. In the shown embodiment, the first engagement portions 100*a* are positioned close to a rear side of the body 100 opposite to the front side wall 130 and are arranged in a row.

As shown in FIGS. 1 and 4, a second aperture 100*b* is formed in a top surface of the front side wall 130 of the body 100, and a second engagement portion 200*b* corresponding to the second aperture 100*b* is formed on the cover 200. The second engagement portion 200*b* is configured to be engaged into the second aperture 100*b*.

As shown in FIGS. 1 to 4, in the illustrated embodiment, a third engagement portion 210 is formed on the cover 200 and is configured to be engaged with an outer side surface of an upper edge of the front side wall 130 of the body 100. In the shown embodiment, the third engagement portion 210 includes an elastic arm extending in a front-and-rear direction and a hook portion 210*a* formed at an end of the elastic arm. The hook portion 210*a* is configured to be hooked on the outer side surface of the upper edge of the front side wall 130 of the body 100. The cover 200 may be formed with two third engagement portions 210 which are respectively located at left and right sides of the cover 200. Further, the cover 200 may be formed with two second engagement portions 200*b* located between the two third engagement portions 210.

As shown in the embodiment of FIGS. 1 and 4, a top surface of the front side wall 130 of the body 100 is formed with a horizontal reinforcing rib 131 extending outwardly therefrom, and the second aperture 100*b* is formed in the horizontal reinforcing rib 131. A vertical reinforcing rib 132 connected to the horizontal reinforcing rib 131 is formed on an outer side surface of the front side wall 130 of the body 100.

As shown in FIGS. 1 and 3, the body 100 is opened or formed with a wire insertion hole at a rear side thereof, so that an external wire can be inserted into the terminal receiving chamber 101 from the rear side of the body 100 and held within the terminal receiving chamber 101 by the cover 200.

An assembly process of the connector housing as described above will be described below with reference to FIGS. 1 to 4.

Step 1: assembling the cover 200 to the body 100 from a top, so that the plurality of first engagement portions 100*a* on the body 100 are inserted into the first apertures 200*a* in the cover 200, respectively.

Step 2: horizontally moving the cover 200 so that the first engagement portions 100*a* are engaged with the first apertures 200*a* to prevent the cover 200 from vertically moving.

Step 3: engaging the second engagement portion 200*b* on the cover 200 into the second aperture 100*b* in the body 100, while engaging the third engagement portion 210 on the cover 200 with the outer surface of the front side wall 130 of the body 100, to prevent the cover 200 from horizontally moving.

It should be appreciated by those skilled in this art that the above embodiments are intended to be illustrative, and many modifications may be made to the above embodiments by those skilled in this art. Further, various structures described in various embodiments may be freely combined with each other without conflicting in configuration or principle.

Although the present disclosure has been described hereinbefore in detail with reference to the accompanying drawings, it should be appreciated that the disclosed embodiments in the accompanying drawings are intended to illustrate embodiments of the present disclosure by way of example, and should not be construed as limitation to the present disclosure. Although a few embodiments of the general inventive concept of the present disclosure have been shown and described, it would be appreciated by those skilled in the art that changes or modification may be made to these embodiments without departing from the principles and spirit of the general inventive concept, the scope of which is defined in claims and their equivalents.

It should be noted that, the word "comprise" doesn't exclude other elements or steps, and the word "a" or "an" doesn't exclude more than one. In addition, any reference numerals in the claims should not be interpreted as the limitation to the scope of the present disclosure.

What is claimed is:

1. A connector housing, comprising:

a body comprising:

a plurality of terminal receiving chambers arranged in a row;

a left side wall;

a right side wall;

a front side wall; and a first engagement portion formed on a top surface of each of the left side wall and the right side wall and at a left side and a right side of each terminal receiving chamber; and a cover mounted on a top portion of the body, the cover has a first aperture corresponding to the first engagement portion, the first engagement portion engages the first aperture to lock the cover to the body;

wherein the top surface of the front side wall has a horizontal reinforcing rib extending outwardly therefrom, and a vertical reinforcing rib connected to the horizontal reinforcing rib is formed on an outer side surface of the front side wall.

2. The connector housing of claim 1, wherein a plurality of partition walls divide an internal space of the body into the plurality of terminal receiving chambers.

3. The connector housing of claim 2, wherein the first engagement portion is formed on a top surface of each of the left side wall, the right side wall, and the plurality of partition walls.

4. The connector housing of claim 3, wherein the first engagement portions are positioned close to a rear side of the body opposite to the front side wall and are arranged in a row.

5. The connector housing of claim 2, wherein a top surface of the front side wall has a second aperture.

6. The connector housing of claim 5, wherein the cover has a second engagement portion corresponding to the second aperture.

7. The connector housing of claim 6, wherein the second engagement portion engages the second aperture.

8. The connector housing of claim 7, wherein the cover has a third engagement portion engaging an outer side surface of an upper edge of the front side wall.

9. The connector housing of claim 8, wherein the third engagement portion has an elastic arm extending in a front-and-rear direction.

10. The connector housing of claim 9, wherein the third engagement portion has a hook portion formed at an end of the elastic arm and configured to be hooked on the outer side surface of the upper edge of the front side wall.

11. The connector housing of claim 8, wherein the cover has a pair of third engagement portions disposed at a left side and a right side of the cover.

12. The connector housing of claim 11, wherein the cover has a pair of second engagement portions between the third engagement portions.

13. The connector housing of claim 5, wherein the second aperture is formed in the horizontal reinforcing rib.

14. The connector housing of claim 1, wherein the body has a wire insertion hole at a rear side thereof.

15. The connector housing of claim 1, wherein the horizontal and vertical reinforcing ribs extend outwardly from the outer side surface of the front side wall in a direction away from the plurality of terminal receiving chambers.

16. A connector housing, comprising:

a body comprising:

a plurality of terminal receiving chambers arranged in a row;

a left side wall;

a right side wall;

a front side wall; and a first engagement portion formed on a top surface of each of the left side wall and the right side wall and at a left side and a right side of each terminal receiving chamber; and a cover mounted on a top portion of the body, the cover having:

a first aperture corresponding to the first engagement portion, the first engagement portion engages the first aperture to lock the cover to the body;

a second engagement portion engaging with a second aperture formed on the front side wall; and a third engagement portion engaging an outer side surface of an upper edge of the front side wall and including an elastic arm extending in a front-and-rear direction and a hook portion formed on an end of the elastic arm and adapted to be hooked on the outer side surface of the upper edge of the front side wall.

17. A connector housing, comprising:

a body comprising:

a plurality of terminal receiving chambers arranged in a row;

a left side wall;

a right side wall;

a front side wall; and a first engagement portion formed on a top surface of each of the left side wall and the right side wall and at a left side and a right side of each terminal receiving chamber; and a cover mounted on a top portion of the body, the cover having:

a first aperture corresponding to the first engagement portion, the first engagement portion engages the first aperture to lock the cover to the body; and a second engagement portion including an elastic arm and a hook portion formed on an end of the elastic arm and engaging an outer side surface of an upper edge of the front side wall.

18. The connector housing of claim 17, wherein the front side wall includes a horizontal reinforcing rib extending outwardly from an outer side surface of the front side wall in a direction away from the plurality of terminal receiving chambers.

19. The connector housing of claim 18, wherein a vertical reinforcing rib connected to the horizontal reinforcing rib is formed on the outer side surface of the front side wall.

20. The connector housing of claim 17, wherein the cover further includes a third engagement portion engaging with a second aperture formed on the front side wall.

* * * * *